US005297484A

United States Patent [19]

Piserchia et al.

[11] Patent Number: 5,297,484

[45] Date of Patent: Mar. 29, 1994

[54] VEHICLE GUIDANCE TRACK SYSTEM

[75] Inventors: Gregory T. Piserchia, Painesville; Eric F. Wilson, Chesterland, both of Ohio

[73] Assignee: Train Products, Inc., Painesville, Ohio

[21] Appl. No.: 725,293

[22] Filed: Jul. 3, 1991

[51] Int. Cl.[5] ..... B61D 17/00; A63H 18/00

[52] U.S. Cl. ..... 105/1.5; 104/DIG. 1; 446/446; 446/455; 191/22 C; 191/29 R; 246/187 A; 238/10 E

[58] Field of Search ..... 105/1.5; 104/DIG. 1, 104/295; 446/446, 447, 455, 467; 191/22 C, 29 R, 45 R, 49; 246/187 A, 187 B, 473 R; 238/10 R, 10 F, 10 E

[56] References Cited

U.S. PATENT DOCUMENTS

| | | | |
|---|---|---|---|
| 2,218,074 | 10/1940 | Smith | 246/473 RX |
| 2,401,468 | 6/1946 | Duffy | 238/10 E |
| 2,962,563 | 11/1960 | Davis | 104/288 |
| 3,075,705 | 1/1963 | Wilhelm | 238/10 R |
| 3,179,063 | 4/1965 | Case et al. | 104/295 |
| 3,552,003 | 1/1971 | Agarwala | 72/54 |
| 3,729,133 | 4/1973 | Covert | 104/295 |
| 3,780,235 | 12/1973 | Deyerl et al. | 238/10 F |
| 3,944,986 | 3/1976 | Staples | 104/88 |
| 4,417,229 | 11/1983 | Wilson | 246/187 B |
| 4,564,162 | 1/1986 | Grimm | 446/447 |

*Primary Examiner*—Robert J. Oberleitner
*Assistant Examiner*—Kevin D. Rutherford
*Attorney, Agent, or Firm*—Renner, Otto, Boisselle & Sklar

[57] ABSTRACT

The present invention relates to a guidance track for an electric vehicle. The guidance track preferably includes one or more grooves formed within a dielectric material. The wheels of the vehicle fit, at least in part, in the grooves which are configured to accept the wheels of both powered and unpowered cars in the vehicle. The grooves guide and direct the vehicle as the wheels travel through the grooves.

30 Claims, 4 Drawing Sheets

VEHICLE GUIDANCE TRACK SYSTEM

TECHNICAL FIELD

The present invention relates generally, as is indicated, to a vehicle guidance track system. More particularly, the present invention relates to a guidance track system for a small electric powered vehicle in which the vehicle is controlled with respect to direction, speed, and function as it travels about the track in the system.

BACKGROUND OF THE INVENTION

Guidance track systems for electric vehicles that travel on or about a guidance track are known in the art. For example, model railroads have been popular for many years. Model railroading centers around an electrically powered engine which is used to pull one or more miniature cars along a track. The track typically consists of two upright, parallel rails that are held in position and separated by a dielectric material usually in the form of miniature railroad ties and, perhaps, additional electric insulators. The parallel rails are shaped to form a number of turns and straightaways in the track along which the train travels. Typically, the rails are made of an electrically conductive metal such as steel or brass. A power supply is used to provide power to the rails.

Each of the respective cars in the train, i.e., the engine and individual rail cars, has a set of wheels that is positioned on the top surface of the rails. It is on this top surface that the wheels ride as the train travels along the track. Wheels of the engine are made, at least in part, of an electrically conductive material which remains in electrical contact with the top surface of the rails as the train travels along the track. Such wheels serve as electrical contacts which allow the power applied to the rails to be coupled through the wheels to an electric motor located in the engine. As a result, the electric motor turns one or more of the engine wheels, and the train is driven along the track. By adjusting the voltage provided to the respective rails, the operator can control the speed and direction of the train.

In addition to model railroading, there are other electric powered vehicles which are guided along a track. For example, there are model race cars and full and small scale monorail vehicles. A few exemplary model train and car systems are described in U.S. Pat. Nos. 2,962,563, 3,729,133 and 3,075,705. Accordingly, although the present invention is discussed primarily in the context of model railroading, it will be appreciated that the present invention has applications in other areas including model cars and the like. In addition, the present invention has applications in controlled assembly, delivery systems and/or production systems, as is described more fully below.

There have been several problems associated with previous small electric vehicle guidance tracks, particularly with respect to model railroading. One problem involves the manner in which the wheels of the train are directed along the track. Typically, the wheels on a standard model train include a radically extending flange or lip formed along the inner edge of the wheel and a cylindrical support surface relatively at the outer edge of the wheel. The flange on each wheel is designed to abut up against the inside edge of the rail as the outer edge of the wheel rides atop the top surface of the rail. The physical interaction between the wheel flange and the inside edge of the rail causes that particular wheel on the train to be directed in the direction of the rail as the train proceeds along the track, as is known.

Unfortunately, often times, the interaction between the wheel flange and the inside edge of the rail is not adequate to prevent the respective wheel from falling off the top of the rail such that the train becomes derailed. With standard model railroad sets, such as HO-gauge or N-gauge, the radial diameter of the wheel flange is relatively small in comparison to the radial diameter of the outer edge of the wheel which rides on top of the rail. As a result, the train, or, more specifically, the wheels of the cars on the train, can become derailed even when travelling at moderate speeds. The flange on the wheel sometimes is not able to counteract the forces exerted on the wheel due to the momentum of the train, and, as a result, the flange slips out of position from the inside edge of the rail, thus causing the wheel to fall off the rail. This is why the wheels of the train are particularly likely to derail when encountering a sharp turn.

Another problem associated with previous model railroads is that after the train has derailed, it is quite unlikely that the train will rerail itself. As is noted above, the rails of the track sit on top of the dielectric material used to separate the rails. As the train derails, the derailed wheels slip from the top surface of the rail and fall off to the side of the rail. Gravity then plays a role in preventing the derailed wheels from returning to their proper position atop the rails. As a result, such tracks in the past have required that the operator shut down the track and reposition the train atop the rails before proceeding after a derailment.

Furthermore, the initial positioning of the train on top of the rails presented a problem to the operator. When dealing with smaller model trains, such as N-gauge and Z-gauge, the wheels on the cars and the rails themselves are so small that it is difficult to align the wheels on top of the rails. This can lead to operator frustration, particularly for children who have not yet developed good hand-eye coordination. In an effort to alleviate this problem, special railing tools have been developed for assisting in properly positioning the cars on top of the rails.

Yet another problem associated with known model trains has been the inconvenience associated with assembling and transporting an entire track layout. Typically, model train track is sold in separate sections ranging from about six to twelve inches in length. The curved and straight sections of track connect together and, thereby, form a complete track or track layout. However, the operator must spend considerable time and money constructing anything but the simplest track layouts. The operator must spend time fitting the respective sections together, a task that can be especially tedious when dealing with smaller tracks, such as N-gauge and Z-gauge. In addition, the sections of track can be costly and will add up quickly to a sizable investment.

A problem often encountered with assembling track layouts in the past involved the individual track sections separating from one another. Usually, only a friction fit would secure the adjoining track sections. Oftentimes, adjoining track sections would separate during assembly or use, and, as a result, the electrical and/or mechanical connection between the adjoining rails would be lost. The loss of an electrical connection between one or more of the track sections would result in there being no power provided to the engine, and the train would not properly function. To complicate matters, it was difficult for the operator to distinguish whether there was a problem with the track or if it was the engine which was not working. Even if the problem were narrowed down to the track, the operator could spend considerable time trying to determine where the separation had occurred.

Furthermore, in order to make the assembled track layout portable in the past, it was necessary to secure the track layout to a piece of plywood or the like prior to moving the track. This involved securing each individual section of track to the piece of plywood using small fasteners such as nails. As will be appreciated, such securing of the layout took a considerable amount of time. Even further, it took time, to disassemble the layout in the event the operator needed sections of track for another layout. In all, transporting a track layout was quite inconvenient.

In view of the above described shortcomings of existing vehicle guidance tracks, there is a strong need in the art for an electric vehicle guidance track that offers superior guidance features and which reduces or eliminates the problems associated with the vehicle becoming derailed. Moreover, there is a strong need for a guidance track which enables a derailed vehicle to retrack itself as it proceeds along the track.

Even further, there is a strong need in the art for a guidance track that is compatible with existing model trains. In addition, there is a need for a guidance track that allows for easy placement of the vehicle on the guidance track without requiring special tools. Moreover, there is a strong need for a guidance track that is preassembled, which has a one-piece construction, which can be easily transported or stored, and which is relatively easy to manufacture.

The present invention addresses one or more of the shortcomings encountered with previous vehicle guidance tracks. The present invention is summarized and described in detail below.

BRIEF SUMMARY OF THE INVENTION

The present invention relates to a guidance track for an electric vehicle. The guidance track preferably includes one or more grooves formed within a dielectric material. In a multiple groove embodiment, the grooves preferably are parallel to one another. The wheels of the vehicle fit, at least in part, in the grooves which are configured to accept the wheels of both powered cars (such as an engine or other powered car) and unpowered cars in the vehicle. The grooves guide and direct the vehicle as the wheels travel through the grooves. The track includes a conductive surface associated with, preferably adjacent to, each groove which can be used to provide electrical power to the vehicle. The conductive surfaces are coupled to a power supply, and the conductive surfaces provide electrical connection with one or more of the wheels of the vehicle. Such connection allows for electrical current to flow between the conductive surfaces and the wheels of the vehicle in order to power the electric motor within the vehicle. Additional conductive surfaces are provided which allow for the wheels of the vehicle to be used in connection with various operations performed in relation to the track system.

More specifically, the wheels of the vehicle may be used in combination with the conductive surfaces to turn on/off a light, open or close a gate, sound a horn, etc. In addition, the electrical connection between the vehicle wheels and the conductive surfaces permits information to be transferred between the vehicle and a control unit used in connection with the track. Such information can be used to control the direction, speed, and/or other auxiliary functions of the vehicle, as is described below.

The guidance track allows the operator to align and position the vehicle wheels within the respective grooves using minimal effort. Of particular importance is that if the vehicle wheels become misaligned in relation to the grooves in the track, the guidance track tends to cause the misaligned wheels to "regroove" automatically. As a result, the vehicle can continue around the track uninterrupted.

The parallel grooves are shaped to form a continuous path or layout in the dielectric material about which the vehicle can travel. The entire layout can be included in a single sheet of dielectric material, thereby eliminating the need for assembling multiple sections of track. The one-piece construction of the guidance track increases the portability of the track and eliminates problems encountered in the past with individual sections of track separating from one another. Conventional machining and printed circuit board techniques can be used to manufacture the guidance track, thereby reducing manufacturing costs. By using printed circuit board manufacturing techniques, a high precision guidance track having complex precision patterns at very small scales can be produced.

Therefore, according to one aspect of the present invention, a vehicle guidance track system is provided which includes a guidance track for a powered vehicle having one or more wheels on which the vehicle travels, the guidance track having a generally planar material having a top surface and at least one groove formed in the top surface, at least one groove having means for receiving at least a portion of one or more of the wheels and means for guiding the wheels such that the vehicle progresses along the guidance track in the direction of the groove or grooves.

According to another aspect of the invention, a guidance track system for an electric powered vehicle has one or more wheels on which the vehicle travels, the guidance track comprising a generally planar material having a top surface, one or more grooves formed in the top surface, each of the grooves having two generally oppositely facing side walls for guiding the one or more wheels such that the vehicle progresses along the guidance track in the direction of the one or more grooves, conductive surface means in proximate relation to at least one of the grooves and means for providing an electric potential to the conductive surface means; and wherein at least one of the wheels will be operative to electrically couple power from the conductive surface means to the vehicle in order to power the vehicle along the guidance track.

According to yet another aspect of the invention, a guidance track system for an electric powered vehicle has one or more wheels on which the vehicle travels, the guidance track comprises a generally planar material having a top surface, at least one groove formed in the top surface, the at least one groove having means for receiving at least a portion of one or more of the wheels and means for guiding the wheels such that the vehicle progresses along the guidance track in the direction of the at least one groove, conductive surface means in proximate relation to at least one of the grooves for engaging in electrical contact with at least one of the wheels, and track controller means for controlling the operation of the vehicle based on electrical information transmitted between the track controller and the vehicle along the conductive surface means.

The foregoing and other objects, features, aspects and advantages of the present invention will become more apparent as the following description proceeds. It will be appreciated that while the preferred embodiments of the invention are described herein, the scope of the invention is to be determined by the claims and equivalents thereof.

To the accomplishment of the foregoing and related ends, the invention, then, comprises the features hereinafter fully described in the specification and particularly pointed out in the claims. The following description and the annexed drawings set forth in detail certain illustrative embodiments of the invention, these being indicative, however, of but a few of the various ways in which the principles of the invention may be suitably employed.

DETAILED DESCRIPTION OF THE PREFERRED EMBODIMENTS

Figure 1:
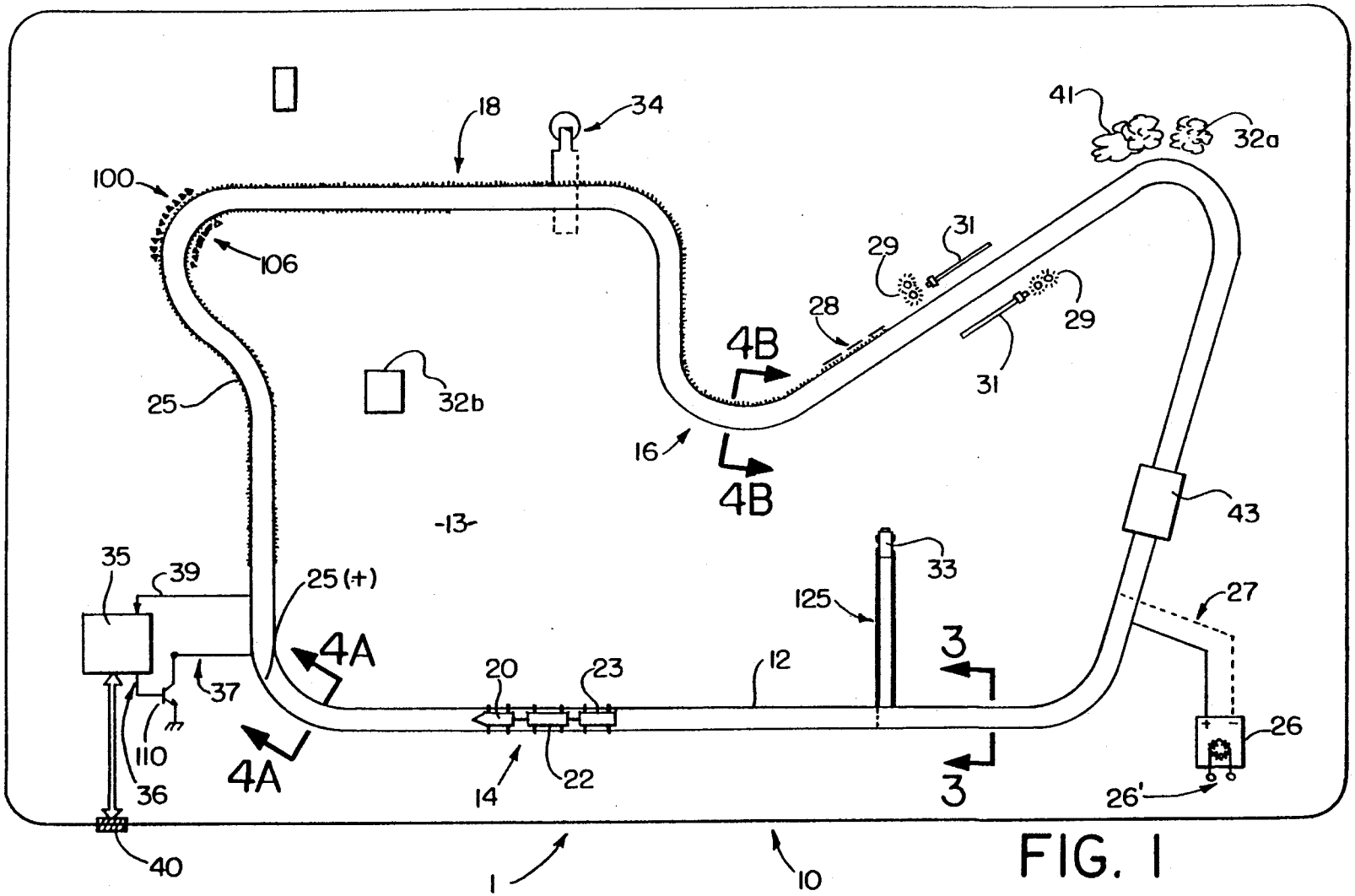
FIG. 1 is a plan view of the guidance track system in accordance with the present invention.

Referring in detail to the drawings, wherein like reference numerals designate like parts in the several figures, and initially to FIG. 1, an electric vehicle guidance track system 1 in accordance with the present invention is shown. The guidance track system 1 includes a guidance track 10 in the exemplary embodiment which has two parallel grooves 12 located in a dielectric substrate 13. The grooves 12 are spaced such that the wheels of the vehicle 14 roll within the grooves 12, at least in part, as the side walls of the grooves 12 interact with the wheels to direct the vehicle through various turns 16 and straightaways 18.

As referred to herein, the vehicle 14 can include one or more individual cars having wheels which roll within the grooves 12. For example, the vehicle 14 may consist of a conventional model train with an engine 20 and one or more cars 22, 23 coupled to the engine which pulls/pushes the cars along the guidance track 10. Alternatively, the vehicle 14 may consist of a single car. Moreover, while the exemplary embodiments of the guidance track 10 and the vehicle 14 are described below as having two parallel grooves 12 and two wheels per axle, it will be appreciated that any number of parallel grooves, or only a single groove, are possible so as to accommodate the wheels of the vehicle 14. Preferably, at least one car in the vehicle 14 includes an electric motor which turns one or more wheels that actually propel the vehicle 14 along the track 10.

In the preferred embodiment, the guidance track 10 provides the electricity to power the electric motor using conductive surfaces 25. The conductive surfaces 25 preferably are located alongside each of the grooves 12 throughout the track and are maintained at a predetermined potential by power supply 26. The conductive surfaces are designed to remain in electrical contact with the wheels of the engine 20 and provide electrical power to the motor through the wheels, as is known with standard model railroads. The potential difference between the conductive surfaces 25 adjacent opposite grooves can be used to control the speed and direction of the vehicle 14. Alternatively, the vehicle 14 is self-propelled and relies on the grooves 12 solely for the purpose of guiding the vehicle.

The power supply 26 is coupled to the conductive surfaces 25 by way of conductive traces 27 on or in the dielectric substrate 13 and supplies the respective voltages to each conductive surface. The conductive traces 27 may be on either the top or bottom surface of the dielectric substrate 13. Alternatively, in an embodiment using a multi-layer substrate 13 having multiple layers of conductors throughout the thickness of the substrate as is known, such conductive traces 27 may be in the substrate. Plated through holes in the substrate may be used to join respective layers as is known. Because the substrate 13 is made of a dielectric material in the preferred embodiment, the power supply 26 can be a power supply circuit formed on the dielectric substrate 13 itself using conventional semiconductor technology. In such cases, an AC power source can be coupled to the power supply 26 using external power input jacks 26' as shown. Alternatively, the power supply 26 can be an external unit such as an AC/DC power converter or a battery pack which is separate and apart from the guidance track 10.

The guidance system 1 includes auxiliary conductive surfaces 28 which are positioned at predetermined locations along the track 10. The auxiliary conductive surfaces 28 and conductive surfaces 25 are used in combination with the wheels of the vehicle to control a variety of auxiliary functions, as explained in more detail below. For example, the wheels of the vehicle which come into contact with an auxiliary conductive surface 28 and a conductive surface 25 can be used to turn on/off lights 29 and/or raise/lower gates 31 which are affixed to the substrate 13.

The guidance track system 1 also may energize, operate and/or include operative and decorative devices. An exemplary decorative device is a tree 32*a* or a house 32*b*, either of which may have associated lights, etc. which may be powered by the system. An exemplary operative device is a loading car 33 which is operated and powered by the system 1, as is described further below.

The guidance track system 1 also includes a status indicator 34 which indicates to the operator that the track 10 is energized. The status indicator 34 in the preferred embodiment includes a light which is electrically coupled across the respective conductive surfaces 25. As a result, whenever power is applied to the track 10, the status indicator 34 light will glow. This eliminates any guesswork on the part of the operator as to whether power is applied to the track or, for example, whether there is a problem with the track or the vehicle 14.

The guidance track system 1 includes a track controller 35 which is used to communicate with the vehicle 14 as it travels about the track 10. In the preferred embodiment, the track controller 35 modulates the voltage on one or more of the conductive surfaces 25 or 28 such that electrical information is communicated along the track. The track controller output 36 is coupled to an exemplary conductive surface 25 by way of conductive trace 37, for example, on or in the substrate 13 similar to the conductive traces 27. The track controller input is similarly coupled to the exemplary conductive surface 25 by way of input line 39, e.g., another conductive trace, such that the controller can receive information transmitted along the conductive surface 25 from another source. An I/O port 40 is provided for communication with an external computer, such as a personal computer or the like.

It will be appreciated that for those instances in which electrical connections are to be made, other than direct connections to the vehicle wheels by the conductive surfaces 25, to various parts of the system 1, electrically conductive traces on, in, or through the substrate 13 are preferred. However, it also is possible to use wires, busses, etc. for this purpose.

As a result of the track controller 35, information, preferably in the form of modulated digital data, can be transmitted and received along one or more of the conductive surfaces 25, 28. Such data is received by the engine 20, for example, and is used to control the speed and direction of the vehicle 14, as is further described below. Similarly, information provided along one or more of the conductive surfaces 25, 28 can be used to control related peripheral items such as a loading car 33. Even further, the engine 20 and track controller 35 can communicate back and forth with one another using the conductive surfaces 25, 28. Such communications can include, for example, position information, speed, estimated time of arrival, etc., as will be apparent from the description presented below.

The guidance track system 1 shown in FIG. 1 includes decorative items such as trees 32*a*, bushes 41, and a tunnel 43. Such items add to the atmosphere of the track system and may be included in the track system 1 during manufacturing. Alternatively, the operator can add such items in a customized fashion. The guidance track system 1 can be manufactured in a variety of sizes, and the grooves 12 may be configured in virtually any layout design. The guidance track system 1 may be virtually any size, including small enough to be carried in a briefcase, or even smaller. Moreover, although the substrate 13 in the preferred embodiment is shown as a single piece, a multiple piece embodiment is contemplated, as is described below.

Figure 2:
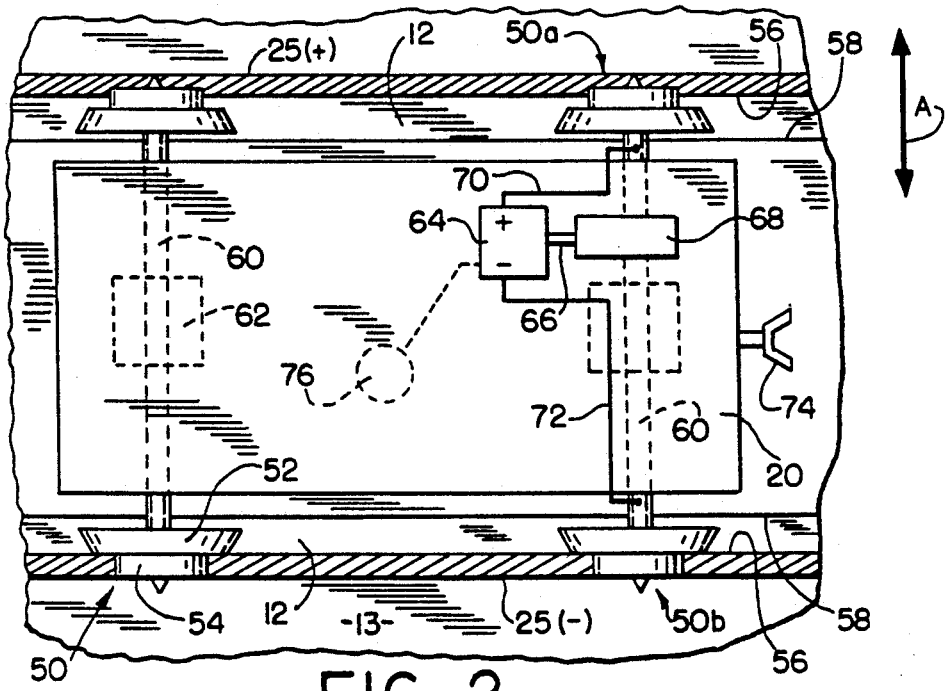
FIG. 2 is a schematic illustration of a conventional model railroad engine and the guidance track system of FIG. 1.

Referring now to FIG. 2, a typical engine 20 is shown in position within the grooves 12 of the guidance track 10. The engine 20 of FIG. 2 exemplifies a commercially available model railroad engine, for example, one used with an HO-gauge train set. The wheels 50 of the engine include an annular, radially extending flange portion 52 and a cylindrical contact portion 54 which usually provides the primary support function of the wheel. Preferably, the flange portion 52 of the wheel 50 is positioned inside the groove 12 as is shown. The contact portion 54 of the wheels rides on the conductive surface 25 immediately adjacent the outer walls 56 of the grooves 12. As the engine 20 progresses along the track, the outer walls 56 and inner walls 58 of the grooves 12 cooperate with the flange to restrict and/or to influence the lateral movement of the wheels 50 such that the wheels 50 travel in the direction of the grooves 12.

The engine 20 includes two axles 60, or the equivalent is thereof, each with a single wheel 50 mounted to each end, although alternate embodiments may have a differing number of wheels or axles. Preferably, each axle rotates about a pivot 62 to facilitate turning as the engine proceeds along the track, as is known. An electric motor 64 is provided to drive the rightmost axle 60, as is shown in FIG. 2. The shaft 66 of the motor is coupled to a gearbox 68 which in turn rotates the axle 60 and wheels 50 to drive the engine 20 along the track 10. In comparison, the non-powered cars 22, 23 are virtually identical to the engine except that the cars do not include a motor 64, and the wheels 50 are permitted to rotate freely so that the cars may be pulled or pushed along by the engine 20. If desired, connections through the wheels to the conductive surfaces 25 in powered or unpowered cars also may be used to power lights or other devices in such cars. Also, signalling through the surfaces 25 and/or by other means may be used to cause operation of an active device, such as a flashing light, fan, etc. in a powered or unpowered car.

In the preferred embodiment, the wheels 50 are made, at least in part, of an electrically conductive metal, such as copper or brass, and the wheels serve as electrical contacts for providing current to the motor 64. More specifically, the contact portion 54 of the wheel is designed to ride atop the conductive surface 25, thereby providing for an electrical connection. The wheels 50*a* and 50*b* are electrically coupled to the terminals of the electric motor 64, as schematically shown by lines 70 and 72, respectively. Because the conductive surfaces 25(+) and 25(−) are maintained at different potentials, current flows through the wheels 50*a*, 50*b* and the electric motor 64 and, as a result, powers the engine 20 along the track. To avoid short circuit, the wheels on an axle are electrically isolated from each other; for example, part or all of the axle 60 may be electrically nonconductive.

The engine 20 includes a coupling device 74 which allows is the engine 20 to be coupled to one or more additional cars 22, 23 when desired. In an alternate embodiment, the engine 20 need not rely on power provided from the conductive surfaces 25 in order to move about the track. Instead, an optional battery 76 (shown in phantom) can be used such that the engine 20 is self-propelled. Moreover, it will be apparent that many aspects of the invention are applicable even in the absence of a powered car in the vehicle 14. In such cases, it is possible that there would not be a need for conductive surfaces 25 at the grooves 12.

Figure 3:
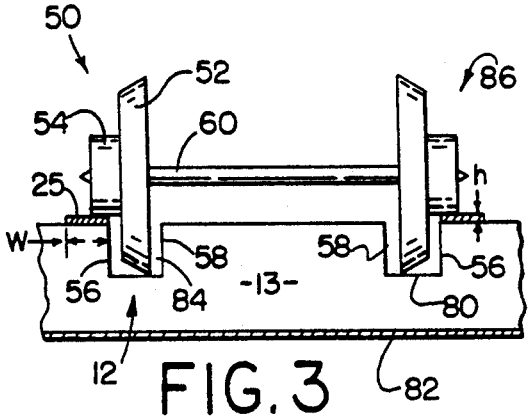
FIGS. 3, 4A, and 4B are partial cross elevation views of the guidance track system of FIG. 1 showing, in particular, the interrelationship between the grooves of the guidance track in accordance with the present invention, and the wheel assembly of a vehicle riding thereon.

Turning now to FIG. 3, an exemplary cross section of the guidance track 10 is shown. As can be seen, the contact portion 54 of each wheel 50 rides on top of conducting surface 25. Each respective groove 12 includes an inner wall 58, an outer wall 56, and a bottom wall 80. As shown in FIG. 3, the flange portion 52 of the wheel 50 rides on top of and in physical contact with the bottom wall 80 as the vehicle 14 progresses along the track 10. It is not necessary that the flange portion 52 actually come into contact with the bottom wall 80 for the reason that contact portion 54 is capable of supporting each wheel 50 as the wheels roll along on top of the conductive surface 25. For example, in the illustrated embodiment shown in FIG. 13, the flange portion does not contact the bottom wall 80.

In an embodiment where it is not necessary that conductive surfaces 25 provide power to contact portions 54, the wheel 50 need not include a contact portion 54 and, instead, can consist solely of the flange portion 52 riding on top of the bottom wall 80. In such an embodiment, all or portions of the conductive surfaces 25 may be omitted, and the guidance track 10 may consist merely of the grooves 12. Furthermore, only those wheels 50 where it is required that the wheel, or some portion thereof, make an electrical connection with the conductive surfaces 25, 28, as explained herein, need to be made of a conductive material. Otherwise, the wheels 50 can be made of plastic or some other nonconductive material.

It is noted that the conductive surfaces 25, 28, as illustrated so far, are of a relatively finite width w and do not extend laterally much beyond that of the contact portion 54 of the respective wheels 50. However, it will be appreciated that such conductive surfaces 25, 28 can be of virtually any width without departing from the scope of the invention. In an embodiment of the track system 1 made by depositing metal on a dielectric substrate, it may be economically worthwhile to minimize the width of the conductive surfaces so as to minimize costs. On the other hand, when manufacturing a guidance track system 1 using metal etching techniques, it may be desirable to have substantially wider conductive surfaces as, for example, described below.

The exemplary embodiment of the invention as described herein includes two parallel grooves 12 which form the track 10. However, it will be appreciated that any number of grooves are possible, including a single groove 12 for use in an embodiment having a monorail-like vehicle 14. Moreover, in an embodiment having plural grooves 12 it is not necessary that the grooves be parallel. For example, the wheels 50 on a given axle 60 may be such as to move freely in an axial direction along the axle 60. Therefore, if the distance between the grooves 12 varies the corresponding wheels 50 will automatically adjust accordingly on the axle 60. Such feature may be particularly desirable when desiring to reduce substantially the minimum turn radius which the wheel/axle assembly can negotiate while traveling along the track.

In the preferred embodiment, the dielectric substrate 13 is generally planar and is of sufficient thickness to include grooves 12 while maintaining its structural integrity. Although it is preferred that the substrate 13 be made of a dielectric material in that it is commonly used in accordance with printed circuit board techniques, other materials also are suitable. For example, wood, plastic and glass may be used as each will provide the desired isolation between conductive surfaces 25.

As mentioned above, the guidance track 10 preferably is constructed using conventional printed circuit board fabrication and machining techniques. The precision grooves 12 are machined into the substrate 13 using a milling or routing machine or the like, and, for increased precision, a laser may be used to cut out each groove 12. The conductive surfaces 25, 28 and any other conductive traces, i.e., 27, 39 (FIG. 1), can be formed on the dielectric substrate by way of photo etching, metal deposition and/or other printed circuit board techniques, as will be apparent. The conductive surfaces may be made of copper or some other conductive metal. In order to reduce corrosion, the copper or other metal surface may be plated with nickel, tin/lead, gold, etc. Alternatively, the conductive surfaces, traces, etc. described above may consist of a thin conductive mylar, formed conductive elements such as stamped metal, rolled aluminum sheets or the like, as will be appreciated by those familiar in the art. The dielectric substrate 13 may be multi-layered and/or may include a ground plane 82 on the surface opposite of that on which the vehicle 14 travels.

The actual layout pattern of the guidance track system 1 and guidance track 10 is purely a design choice; any number of turns or straightaways can be combined. Depending on the application, a decoratively shaped track may be desirable or, in the alternative, a more functional layout would be appropriate. Regardless, the actual grooves 12 may be cut into the substrate in accordance with the desired pattern.

There are economic advantages to using printed circuit board techniques to manufacture the guidance track system I of the present invention. For example, the guiding track systems can be mass produced at relatively low cost as compared to standard model railroad track. Moreover, the guidance track system 1 can be manufactured in smaller sizes and within more stringent tolerances than that which is ordinarily found with commercial model railroads. In addition, the dielectric substrate 13 allows the power supply 26, controller 35, and other circuitry to be manufactured as a direct part of the guidance track system 1 itself. The various circuits, conductive surfaces, traces, etc. all may be formed during the manufacturing process using conventional printed circuit board techniques.

Referring specifically to the grooves 12, as illustrated in FIG. 3, the grooves 12 are rectangular in cross section so as to have parallel side walls. However, other shaped grooves are possible, for example, U-shaped or V-shaped, or even some non-symmetrical shape. The principal requirement is that the grooves be shaped so as to permit the wheels to travel through the grooves and that the grooves 12 include two side walls to exert directive forces on the wheels 50, as described below.

The dimensions of each groove 12 are a function of the size of the wheel and the overall wheel assembly 86 of the vehicle 14. Preferably, the distance between the outer wall 56 and inner wall 58 is sufficient to permit the wheel 50 to be inserted and rotate freely therein. The depth of the groove 12 is dependent upon the diameter of the flange portion 52 and whether or not it is desired that the flange portion 52 come into contact with the bottom wall 80, for example to support the wheel 50 and/or to contact a conductive surface 28*a* (FIG. B). Alternatively, the flange portion 52 need not contact the bottom wall 80, as the contact portion 54 riding atop the surface of the substrate 13 will support the wheel.

The distance between the respective grooves 12 is dependent upon the width of the wheel base, i.e., the distance between the wheels 50 on axle 60. Preferably, the wheels 50 are able to be positioned generally in the middle of the respective grooves 12 to allow for a small area of play 84 on each side of the wheels 50. Therefore, when the vehicle 14 enters a turn in the grooves 12, the wheels 50 are gently urged by the outer walls 56 and/or the inner walls 58 in the direction of the turn, as described below. In addition, preferably the conductive surfaces 25 along the edge of the grooves 12 are spaced such that the contact portion 54 of the respective wheels 50 rests atop the conductive surface 25, and wherein the contact portion 54 remains atop the conductive surface regardless of the lateral position of the wheel assembly 86.

Figure 4A:
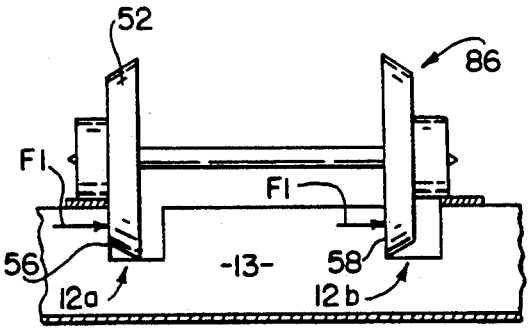
Figure 4B:
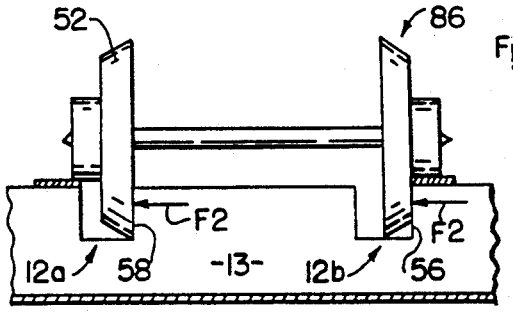

In describing the guiding features of the track 10, reference is made to FIGS. 3, 4A and 4B. FIG. 3 represents the typical positioning of the wheel assembly 86 as it travels through a straightaway portion of the track. As the wheel assembly 86 enters a right turn in the track (assuming the wheel assembly is rolling/travelling forward looking into the page), the tendency will be for the left wheel and right wheel flanges 52 to come into contact with the outer wall 56 of groove 12*a* and inner wall 58 of groove 12*b*, respectively, as is shown in FIG. 4A. In response, the outer wall 56 and inner wall 58 each exert a rightward directed lateral force F1 upon the respective sides of the flange portion 52 of the respective wheels, as is shown. The forces F1 urge the wheels to continue in the direction of the grooves 12 as the vehicle 14 progresses along the track.

FIG. 4B illustrates the wheel assembly 86 undergoing a leftward turn, as exemplified by arrows 4B—4B in FIG. 1. Again, the natural tendency of the wheel assembly 86 will be to come into contact with the inner wall 58 of groove 12*a* and the outer wall 56 of groove 12*b* as the vehicle 14 enters the turn. As a result, the respective inner wall 58 and outer wall 56 impart a leftward directed force F2 on the flange portion 52 of the wheels 50 in order to redirect the wheel assembly 86 in a leftward direction. In such manner, the guidance track 10 of the present invention is capable of directing the vehicle 14 in the direction of the grooves 12 as it travels through the grooves 12.

It will be appreciated that depending on the relative distance between the wheels 50 in the wheel assembly 86 and depending on the distance between the grooves 12 and the width of the grooves, the directing forces, e.g., $F_1$, $F_2$, may be exerted on the wheel assembly 86 by a single inner wall 58 or outer wall 56. Thus, while FIGS. 4A and 4B show an inner and outer wall pair each exerting a directive force, the vehicle will be guided equally as well if only a single wall exerts a directive force. For example, only the left wheel flange 52 may come into contact with the inner wall 58 of groove 12*a* during a leftward turn similar to that shown in FIG. 4B.

One particular advantage offered by the present invention as compared to a conventional model railroad track is that the guidance track 10 offers increased directing capabilities by virtue of its using up to two side walls per groove to exert directive forces on the wheels 50 as opposed to only a single side wall. Conventional model railroad tracks, for example, direct the wheels of the train by using only the single inner edge of the respective rails in combination with a flange on the wheels, as is known. Moreover, the grooves 12 reduce the likelihood of the vehicle 14 becoming misaligned or "degrooved". The inner wall 58 and outer wall 56 combine to partially surround the wheels 50 therein. In contrast, in a conventional model railroad track, the wheels are bounded only on one side by the inner edge of the rail, as described above. This allows the wheel to derail as described above. Thus, the invention described herein permits the vehicle 14 to travel at increased speeds along the track 10 with less chance of becoming derailed.

Figure 5A:
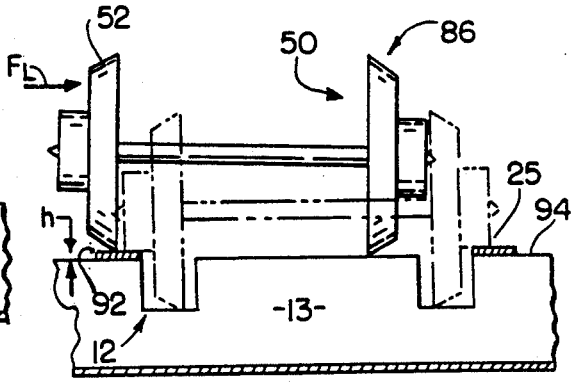
FIG. 5A is a partial cross elevation view of the guidance track system of FIG. 1 in accordance with the present invention, showing, in particular, the misalignment of a wheel assembly.

Although unlikely, it is possible that one or more of the wheel assemblies 86 in the vehicle 14 will become misaligned or degrooved, as illustrated in FIG. 5A. However, the guidance track 10 is designed to facilitate the automatic regrooving of the misaligned wheel assembly 86 in the event of such an unlikely occurrence. Thus, the guidance track 10 provides for the misaligned wheel assembly 86 to return automatically to its proper aligned position, as is illustrated in FIG. 3.

More specifically, the regrooving feature of the present invention takes advantage of the lateral forces which are applied to the individual cars in the vehicle 14 as the vehicle progresses along the track 10. FIG. 5A illustrates an exemplary wheel assembly 86 which has become misaligned and sits atop the dielectric substrate 13 outside of the grooves 12. Such misalignment could occur, for example, due to a piece of debris on the track, improper initial positioning of the car, or operating the vehicle 14 at an excessive rate of speed. As can be visualized from FIG. 5A, it is necessary that a lateral force somehow be applied to the wheel assembly 86 so as to urge the assembly 86 to the right. If the wheel assembly 86 were to be urged to the right with a lateral force $F_L$, the wheels 50 would return to their proper position within the grooves 12, as shown in phantom. More specifically, by urging the misaligned wheel assembly 86 in a rightward, lateral direction, the respective wheels 50 will tend naturally to slide and/or roll across the surface of the dielectric substrate 13 and eventually fall into the respective grooves 12 due to the effects of gravity.

Figure 5B:
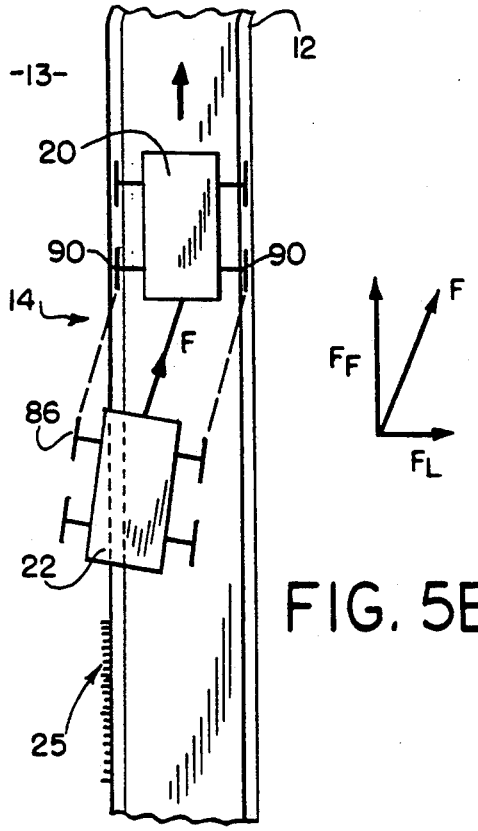
FIGS. 5B and 5C are schematic diagrams showing an exemplary regrooving feature of the present invention.

The lateral force utilized to regroove the misaligned wheel assembly 86 preferably is provided by virtue of the pulling force F which is exerted on the misaligned vehicle by the preceding car which is coupled to the misaligned vehicle. FIG. 5B illustrates an exemplary situation where the wheel assemblies 86 of car 22 have come out of the grooves 12; thus, the car 22 is misaligned. The engine 20, or, alternatively, another non-powered car travelling in front of car 22, exerts a pulling force F which is directed in a non-parallel direction in relation to grooves 12, as is shown. The pulling force F can be broken down into its component forward force, $F_F$, and lateral force, $F_L$, as is indicated. The lateral component $F_L$ provides the desired lateral force which is exerted on the misaligned wheel assembly 86 as the vehicle 14 continues along the track, thereby urging the assembly 86 to proceed in a slightly transverse direction (indicated in phantom). As a result, the wheels 50 will quickly intercept the respective grooves 12 at point 90 in the track 10, and the wheels 50 will fall automatically into the grooves 12. In this exemplary manner, the guidance track 10 of the present invention provides for the automatic regrooving of the misaligned vehicles.

Figure 5C:
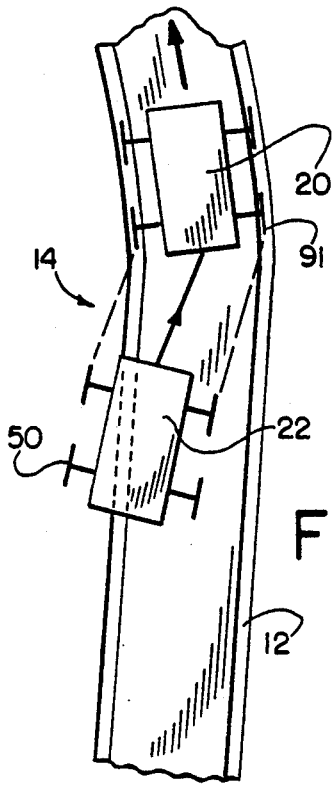

FIG. 5C illustrates how the concept of regrooving also occurs when the vehicle 14 approaches a turn. When the turn in the track 10 is directed to the side of the grooves 12 to which the wheels 50 are misplaced, in this case to the left side of the page, the wheels 50 will tend to proceed in a direction (shown in phantom) towards the grooves 12. This results in the wheels 50 falling into their respective grooves 12 at point 91 as the turn is negotiated. Furthermore, it although FIGS. 5A–5C illustrate a regrooving procedure wherein the vehicle 14 is misaligned to the left of the respective grooves 12, it will be appreciated that the same principles apply when dealing with a vehicle 14 which is misaligned to the right of the grooves 12.

The regrooving process described with respect to FIGS. 5A–5C is described primarily in the context of the vehicle 14 traveling in a forward direction, i.e., the engine exerting a pulling force on the misaligned car. However, it will be appreciated that the same regrooving feature of the invention applies when the vehicle is travelling in reverse, i.e., the engine exerting a pushing force. In such case, regrooving typically occurs as the misaligned wheels 50 are pushed into a turn in the track. More specifically, when the turn in the track is to the side to which the wheels 50 are misplaced, the wheels 50 will be pushed into the corresponding grooves 12.

One consideration when manufacturing the guidance track 10 is that it is desirable to avoid making the height of the conductive surfaces 25 too high so as to restrict the ability of the wheels 50 to cross over the conductive surfaces 25 in order to regroove themselves. Specifically, the height of corner 92 (FIG. 5A) should be relatively short compared to the diameter of the wheel 50 such that the wheel 50 can roll and/or slide across the top of the conductive trace 25 during its attempt to regroove.

If using the guidance track 10 with a conventional N-gauge model train as the vehicle 14, the outermost diameter of the wheel flange portion 52 is approximately 0.275 inch. In such case, it is desirable that the overall height of the conductive surface 25 not extend above the surface 94 of the dielectric substrate 13 by more than 0.010 inch. As a general rule, it is desirable that the height of the conductive surface 25 not extend above the surface 94 more than 5% of the outermost diameter of the wheel 50. However, in an alternative embodiment, the conducting surface 25 can be recessed into the dielectric material 13 such that the top surface of the conducting surface 25 is flush with surface 94.

Figure 6:
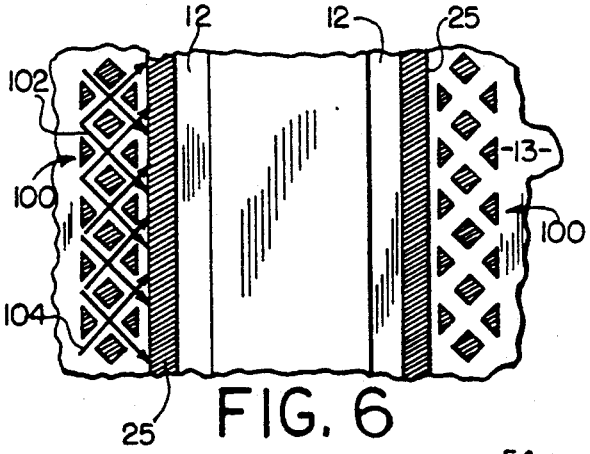
FIG. 6 is a partial plan view of the guidance track system of FIG. 1, including directing traces for facilitating regrooving in accordance with the present invention.

Thus, the grooves 12 in the guidance track 10 provide for the regrooving of the misaligned vehicle as the vehicle progresses along the track. Moreover, to even further facilitate the regrooving of the wheels in the misaligned vehicle 14, the guidance track system 1 can include directing traces 100, as is shown in FIGS. 1 and 6. As is shown in FIG. 6, specifically, the directing traces 100 form a plurality of recessed channels 102, 104 between which the wheels 50 of a misaligned wheel assembly 86 can travel. As will be apparent, the wheels 50 will tend to naturally fall into one of the recessed channels 102, 104 as the misaligned wheels travel across the channels. The recessed channels are angled in order to direct the wheels 50 back towards their respective grooves 12. Therefore, the wheels will fall into place within the grooves 12. As shown, the recessed channels 102, 104 preferably run in opposite directions and, therefore, are operative to direct the misaligned wheels regardless of the direction of travel of the vehicle or whether the vehicle is traveling in a forward or reverse direction.

The directing traces 100 in the preferred embodiment are located only at such areas where misalignment is more likely to occur, for example, at a hairpin turn 106. Alternatively, the directing traces 100 can be positioned adjacent the conductive surfaces 25 along the entire track. Moreover, although the directing traces 100 are not necessary in order for the misaligned vehicle to become regrooved as described with respect to FIGS. 5A–5C for example, the directing traces 100 may be desirable to speed up the regrooving process at given locations along the track 10. For convenience, the directing traces preferably are photo etched or deposited on the surface of the substrate 13 in the same manner as are conducting surfaces 25.

In yet another embodiment, the guidance track system 10 may include a retaining wall which runs generally parallel to one or both outer walls 56 on the surface of the substrate 13. Such retaining wall or walls limit the extent which the wheels 50 may become misaligned before abutting up against the wall. In one embodiment, the wall may be angled towards the respectively adjacent groove 12. As a result, the track system 1 will further facilitate the regrooving of the vehicle by providing an additional directive force.

Figure 7:
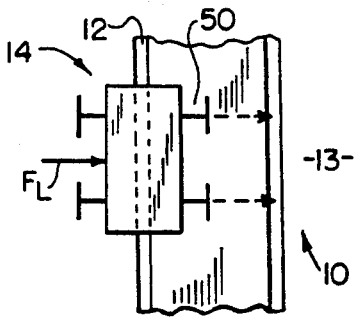
FIG. 7 is a schematic illustration showing an exemplary initial placing of a vehicle onto the track in accordance with the present invention.

Turning now to FIG. 7, shown is how the guidance track system 1 of the present invention facilitates the initial placing of the vehicle 14 onto the track system 1. FIG. 7 illustrates how the vehicle 14 can be initially placed on the track system 1 so as to straddle one of the grooves 12. Thereafter, the operator simply exerts a generally lateral moving force on the vehicle 14 so as to move the vehicle 14 in a lateral direction in relation to the grooves 12. As a result, the respective wheels 50 will slide across the surface 94 of the substrate 13 until each wheel falls into its proper position within the grooves 12. Alternatively, the vehicle wheels 50 can be inserted directly into the grooves 12. Thus, the initial positioning of the vehicle 14 on the track system 1 does not require the same high degree of hand-eye coordination as guidance tracks in the past. The operator has the option of placing the vehicle wheels down into the grooves directly, or alternatively, by first straddling a groove and then simply applying a lateral force. It is important to note that when dealing with model railroad tracks in the past where the rails are positioned above the dielectric material, a simple lateral motion is prevented by the rails themselves.

Figure 9:
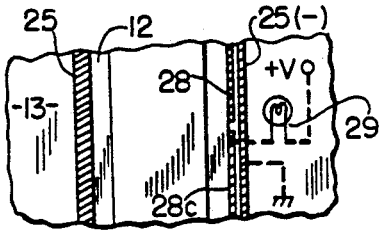
FIG. 9 is a partial plan view of the guidance track system showing an alternate embodiment of the conductive and auxiliary surfaces of FIG. 8.
Figure 8:
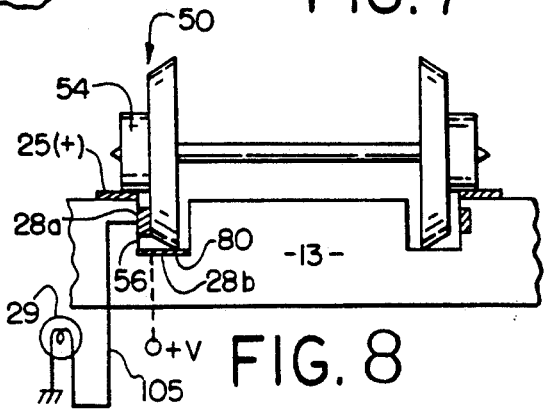
FIG. 8 illustrates the guidance track in partial cross section including the conductive and auxiliary conductive is surfaces used in accordance with the present invention.

Referring now to FIGS. 8 and 9, illustrated are various approaches for using the conductive surfaces 25 and auxiliary conductive surfaces 28 to control such features as a light 29. The auxiliary surfaces 28 may be positioned, for example, to the outer wall 56, bottom wall 80, inner wall 58 or adjacent to the existing conductive surface 25. Alternatively, in those embodiments not requiring a conductive surface 25, one or more auxiliary surfaces 28 can be used in place of the conductive surface 25.

Referring specifically to FIG. 8, an auxiliary conductive surface 28*a* is mounted and/or deposited to the side wall 56. Alternatively, the auxiliary conductive surface 28*a* is an exposed trace in a multilayer substrate 13 embodiment. The auxiliary surface 28*a* is connected to one terminal of a light by way of line 105. The other terminal of the light is connected to ground. When a wheel 50 with a contact portion 54 comes into contact with both the conductive surface 25(+) and the auxiliary surface 28, a closed circuit is created as the wheel 50 functions as a switch to provide current to light 29. Thus, as the vehicle 14 progresses along the track 50 and one or more wheels 50 come into contact with the auxiliary surface 28, light 29 will glow. Alternatively, the wheel 50 can provide the electrical connection between auxiliary surface 28*b* on the bottom wall 80 and auxiliary surface 28*a* on the side wall 56 in order to complete the circuit which causes light 29 to glow. In such instance, surface 28*b* is tied to voltage V.

In the embodiment shown in FIG. 9, auxiliary trace 28*c* is positioned adjacent to conductive surface 25 can be used to turn on light 29. The contact portion 54 of the wheel 50 provides the electrical connection between the parallel surfaces, thereby allowing current to flow and causing the light 29 to glow.

In view of the above examples, it will be appreciated that while the use of such auxiliary surfaces 28 in the groove and adjacent the groove are described in connection with causing light 29 to glow, various other functions can be performed, such as raising and closing gates 31, for example. Moreover, the auxiliary surfaces 28 are formed on the dielectric substrate 13 using the same printed circuit board techniques which are used to make the conductive surfaces 25 and the various traces. The surface type auxiliary surfaces 28*c* are preferred perhaps because a single etching step will form both the conductive and auxiliary surfaces 25 and 28*c*. This leads to reduced manufacturing costs. However, metal deposition, masking, and other techniques, including multi-layered boards with multi-layered traces can be used equally as well.

Figure 10:
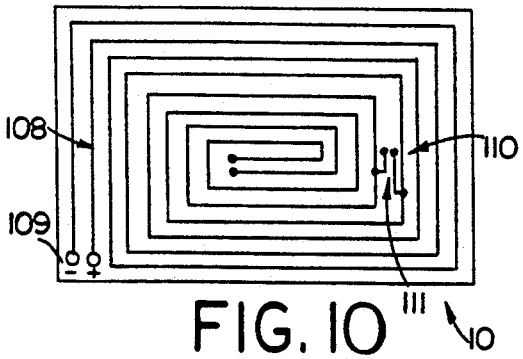
FIG. 10 shows an exemplary embodiment of the back surface of the guidance track system shown in FIG. 1 in accordance with the present invention.

Turning now to FIG. 10, an exemplary underside of the substrate 13 of the guidance track system 1 of FIG. 1 is illustrated. In such embodiment, rather than having a complete ground plane 82 on the underside of the substrate 13, a parallel trace pattern 108 is utilized which provides two parallel traces connected to the power supply 26 using, for example, plated through holes 109. The trace pattern 108 permits the operator to simply drill holes through the substrate 13 in order to access the voltage(s) applied to the respective traces. For example, the operator may wish to install a light or other electrical device. Instead of having multiple wires and cables running across the surface of the substrate, the operator can use a small drill to form one or more holes 110 through which wires 111 can be located. The end of the wires ill can be soldered or otherwise connected to the trace pattern 108 such that power is provided to the device connected to the wires Ill on the opposite side of the substrate 13.

Figure 11:
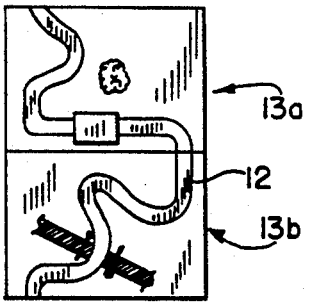
FIG. 11 illustrates a modular embodiment of the guidance track system in accordance with the present invention.

Moreover, while the above embodiments have been described primarily in the context of a single substrate 13, FIG. 11 illustrates that the substrate 13 may, in fact, consist of multiple sections 13*a* and 13*b*, for example. The guidance track system 1 can be made up of multiple substrates 13*a* and 13*b* which interlock such that the grooves from one board align with those of another, thus providing the operator with the ability to construct an even larger layout.

Referring again to FIG. 1, the guidance track system 1 of the present invention provides for computerized operation of the vehicle 14 in order to perform various functions. As was mentioned above, the track controller 35 is capable of sending information along the track 10 to the vehicle 14 and/or other peripheral devices such as the loading car 33. The controller 35 includes a computer programmed to transmit, receive and process the appropriate digital information. In addition, the controller 35 can communicate with an external computer (not shown) by way of I/O port 40.

There are a variety of techniques for delivering and processing digital information along the track 10, as will be apparent to those knowledgeable in computerized controls. One method utilizes a pull down transistor 110 to modulate the voltage provided on conductive surface 25(+). By forward biasing the transistor 110, the controller 35 can effectively modulate the voltage on the conductive surface 25(+) throughout the entire track 10 based on the controller output 36. This modulated voltage can be demodulated using known techniques and is used to control the vehicle 14 and/or other peripheral devices, as described below. Similarly, a modulated voltage on the conductive surface 25(+) can be received and demodulated by the controller 35 by way of input 39. Preferably, the amplitude and frequency of the modulation is such that the powered vehicle 14 remains virtually unaffected by the fluctuating voltage, as is known.

Figure 12:
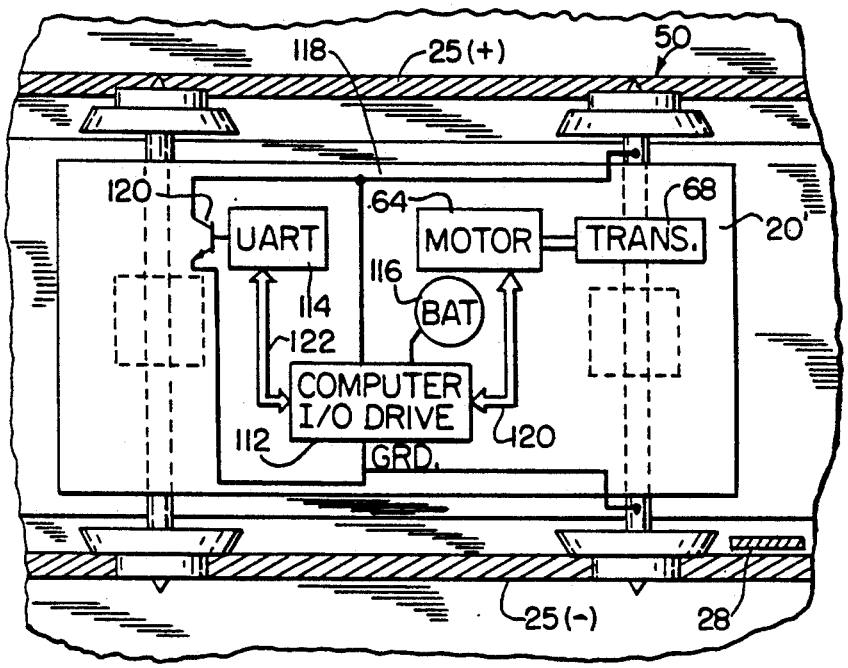
FIG. 12 is a schematic illustration of an alternate embodiment of the vehicle used in connection with the guidance track system of FIG. 1 in accordance with the present invention.

An exemplary engine 20′ for use with vehicle 14 is shown in FIG. 12. The engine 20′ is configured so as to be able to communicate with the controller 35 based on information sent along the conductive surfaces 25, as described above. The engine 20′ includes a computer 112 which processes the desired information for controlling the engine as it is received from the controller 35. In the preferred embodiment, the engine 20′ includes a UART 114 for receiving and transmitting serial data along the conductive surface 25(+). Battery 116 provides a constant power source to the computer 112.

During operation, serial data supplied along the conductive surface 25(+) is received through the wheel 50 and is transmitted along data line 118 to UART 114 where the data is received. The UART 114 converts the incoming serial data into parallel data which consequently is input into the computer 112 through data lines 122 for processing. The serial data may include, for example, speed information whereby the computer 112 provides an output to the motor 64 along lines 120 which drives the motor 64 at the appropriate speed. Such a controllable motor 64 may be, for example, a stepper motor, as is known. Alternatively, the incoming data may cause the computer to send a control signal to the motor along lines 120 which reverses the direction of the motor 64 so that the vehicle 14 will travel in the opposite direction.

In the preferred embodiment, the engine 20′ also communicates with the controller 35 so as to provide, for example, location information. Parallel data from the computer 112 is provided to the UART 114, or its equivalent, through data lines 122 where it is converted to serial data, as is known. The UART 114 then outputs the data by way of controllably forward biasing transistor 122 such that the voltage on conductive surface 25(+) is again modulated by being pulled down to ground, as described above. The controller 35 receives the information by way of its I/O 37 which is coupled to the conductive surface 25(+). The information may represent the engine 20' speed, location, estimated time of arrival, etc. The engine 20' also can send error messages when, for example, the progress of the vehicle 14 is impeded by an obstruction such as debris on the track.

Further, the controller 35 and/or the engine 20' can be used to control peripheral devices such as loading car 33 by way of conductive traces 25, 28 for example. Loading car 33 can be designed similar to the engine 20' such that when the appropriate control signal is received, the loading car 33 is directed to travel along track portion 125. Thus, both the loading car 33 and the engine 20' can be controlled such that both cars meet, and the loading car 33 can perform the desired function, e.g., loading or unloading the train.

Moreover, the system 1 may include supplemental circuits (not shown) which communicate with other devices such as the controller 35, engine 20, loading car 33, etc., in order to achieve a desired result. For example, the controller 35 may activate a gate independently of the position of the vehicle. The supplemental circuits may be fabricated on the substrate 13 using known printed circuit board techniques. All of the respective supplemental circuits, conductive surfaces 25, 28, controller 35 etc. may be interconnected as desired using traces or the like in or on the substrate 13 as described above. Such supplemental circuits may include a timer for determining the duration which the gate is in the down position, an auxiliary controller for overseeing operations of the loading car 33 or other peripheral devices, etc.

Figure 13:
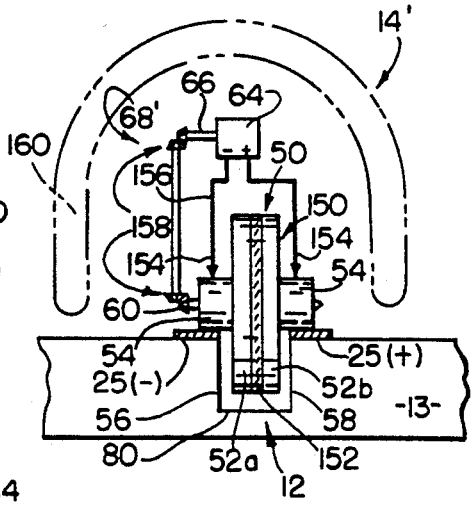
FIG. 13 is a schematic illustration of a single wheel, single groove embodiment of the present invention.

Referring now to FIG. 13, a single wheel, single groove embodiment of the present invention is shown. The vehicle 14' has a wheel 50 which includes two flange portions 52*a*, 52*b* that form a single unitary flange 150 for interacting with the inner and outer walls 56, 58 respectively of the groove 12. In the same manner as is described above, directing forces exerted on the flange portions 52*a*, 52*b* by the groove walls guide the single wheel vehicle 2011 in the direction of the groove 12.

The flange portions 52*a*, 52*b* can be made either of a conductive or non-conductive material and may interact with various auxiliary surfaces 28, as described above. In the event the flange portions 52*a*, 52*b* are made of a conductive material, an isolator 152 is included in order to provide electrical isolation between the respective contact portions 54. As previously described, the contact portions 54 engage in electrical contact with the respective conductive surfaces 25 in order to provide power to the vehicle 14'. Brush contacts 154 or the like couple the power provided by the conductive surfaces 25 to the electric motor 64 by way of wires 156. By changing the polarity of the voltage applied to the motor 64, it is possible to control whether the vehicle 14' travels in a forward or reverse direction along the groove.

The motor shaft 66 is in geared engagement with the axle 60 of the wheel 50 by way of the gearbox 68'. In the illustrated embodiment, the gearbox 68' includes two perpendicular gear networks 158 to provide the desired transfer of rotational power. However, it will be appreciated that countless other arrangements will work equally well. The vehicle 14' also includes a housing 160 (shown in phantom) which can comprise a decorative shell or the like.

Figure 14:
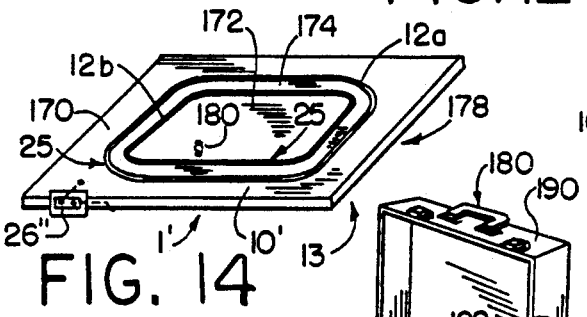
FIG. 14 is a perspective view of yet another embodiment of the present invention.

Turning now to FIG. 14, shown is an alternate embodiment of the guidance track system 1' of the present invention. While the grooves 12, as illustrated, form a basic oval track 10 layout, it will be appreciated that a track shape equally applies. In this particular embodiment, the conductive surface 25(+) is made up of the conductive surface area 170 on the substrate 13 which is external of the oval formed by groove 12*a*. The conductive surface 25(−) is formed by the conductive surface area 172 on the substrate 13 which is interior to the oval formed by groove 12*b*. The surface area 174 between the respective grooves may or may not be conductive. The wheel assembly 86 (not shown) preferably is designed so as to avoid creating a short circuit between conductive surfaces 25(+) and 25(−) in the event surface 174 is conductive. Alternatively or in addition, surface 174 may be non-conductive.

A vehicle 14 is able to proceed along the track 10' in the same manner as described above with respect to the embodiment shown in FIG. 1. It is noted, however, that in the embodiment of FIG. 14, the conductive surfaces 25 are not of a fixed width but instead encompass the respective surfaces 170 and 172. A power jack 26" allows on-board or external power to be applied to the respective conductive surface 25. One terminal of the power jack 26" is electrically coupled to surface 170. The other terminal is electrically coupled to the conductive bottom surface 178 of the substrate 13. A plated-through hole 180 electrically couples the bottom surface 178 to the surface 172. As a result, the conductive surfaces 25 as formed by surfaces 170 and 172 are energized by way of applying power across the respective terminals of the power jack 26".

The preferred method of making the system exemplified in FIG. 14 involves the processing of a double-sided dielectric substrate 13. As is conventional, double-sided refers to the fact that both sides of the substrate are coated with a conductive material such as copper. Grooves 12 are machined into the top surface of the substrate 13 so as to form the desired groove pattern in the dielectric material. A card edge connector is used as the power jack 26" with one terminal of the connector soldered directly to the surface 170, as is shown, and the other terminal soldered directly to the bottom surface 178. As is noted above, a plated-through hole 180 is used to provide the connection between the bottom surface 178 and the surface 172 inside the oval. The various conductive surfaces may be plated with nickel, tin/lead, etc. if desired. Moreover, various portions of the respective surfaces may be masked off to provide electrical isolation and/or to serve as a means for decorating the track 10. For example, a white contact paper can be used to simulate snow; green contact paper can be used to simulate grass, etc. Additional control circuitry, power circuitry, gates, trees, etc. may be added to the overall system in the same manner as was described above.

Figure 15:
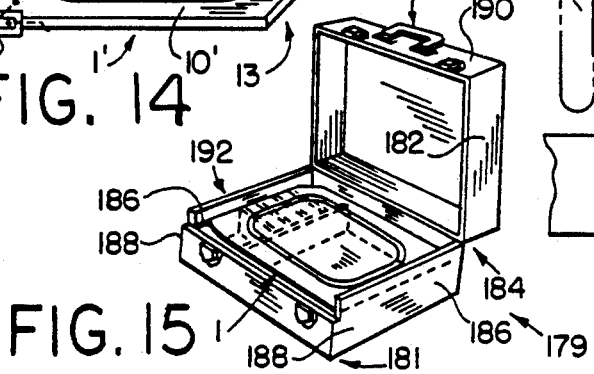
FIG. 15 is a schematic illustration of a carrying case for use in accordance with the present invention.

FIG. 15 illustrates a portable carrying case 179 with a handle 180 for conveniently transporting the system 1 such as that shown in FIGS. 1 or 14. The case 179 in the preferred embodiment includes two box-like halves 181, 182 which are hinged together along an edge 184 so as to rom a briefcase-like carrying case. The bottom half 181 includes two parallel slots 186 in the sidewalls 188 which enable the edges of the substrate 13 of the system 1 to be slid in and out. By sliding the system into the carrying case slots 186 and then closing the case so that the front wall 190 of the top half 182 prevents the system from sliding out, the system 1 may be transported easily to another location.

The carrying case protects the system from damage, and the operator can utilize the system 1 as it sits inside the case 179, or the system may be removed from the case and operated separately. Multiple systems may be sorted in the case using several pairs of slots, for example, as will be appreciated. Moreover, the carrying case 179 permits the operator to change the system 1 within the case with another system layout by simply sliding one system out from the slots 186 and replacing the void by sliding in another system substrate.

Thus, the present invention provides added portability and interchangeability between a variety of layouts. Moreover, the carrying case 179 may include separate compartments 192 (shown in phantom) for housing the vehicle(s) 14, power supply, etc.

In view of the present disclosure, it will be apparent that there are many functional possibilities available as a result of the control features of the controller 35 and engine 20' as well as other related circuitry. While the invention is described primarily in the context of a model train arrangement, the guidance track system 1 and vehicle 14 can be operated as part of an assembly, delivery system, production environment or similar situation requiring controlled guidance capabilities. The vehicle 14 could transport a workpiece to various stations located about the track 10 where different tasks are performed.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

What is claimed is:

1. A guidance track system for a vehicle having at least two wheels on which said vehicle travels, said guidance track system comprising:

a generally planar uniform material having a top surface;

at least two grooves in said top surface, each of said two grooves having means for receiving at least a portion of a respective wheel and means for guiding said respective wheels such that said vehicle progresses along said guidance track in the direction of said groove;

each of said grooves including two generally oppositely facing side walls for guiding said portion of said wheel therein, and wherein said side walls are formed by said uniform material;

wherein said means for receiving comprise a cavity at least partly defined by said side walls;

said means for guiding comprising said side walls, and wherein said side walls are operative to exert directive forces on a respective wheel;

wherein each of said wheels has a flange portion which is received by said cavity;

wherein said directive forces are exerted on said flange portion;

wherein each of said wheels further has a contact portion which rides at least one of on or above said top surface;

further comprising a respective conductive surface on said top surface, each being adjacent to at least a portion of a respective one of said two grooves, and wherein said contact portion of said wheels engages in electrical connection with a respective conductive surface;

further comprising means for providing a voltage across said respective conductive surfaces;

wherein said contact portion on said at least one wheel electrically couples said voltage on said conductive surfaces to an electric motor in said vehicle to power said vehicle along said track;

said material comprising a dielectric substrate, and wherein said conductive surfaces comprise metal which is fixedly attached to said top surface; and wherein said metal comprises a layer of at least one of a conductive thin film, a photo-etched material and deposited metal.

2. The guidance track system of claim 1, wherein each of said grooves includes a bottom wall, and wherein said side walls of each groove are perpendicular to said bottom wall thereof.

3. The guidance track system of claim 2, further comprising an auxiliary conductive surface for forming an electrical circuit between at least one of said wheels and a respective conductive surface to control a peripheral device on said track.

4. The guidance track system of claim 3, wherein said auxiliary surface is positioned on at least one of the top surface, bottom wall and side walls.

5. The guidance track system of claim 2, wherein at least one of said flange portion and contact portion rotate in physical contact with said bottom wall and top surface, respectively.

6. The guidance track system of claim 1, further comprising an auxiliary conductive surface for forming an electrical circuit between at least one of said wheels and a respective conductive surface to control a peripheral device on said track.

7. The guidance track system of claim 6, wherein said auxiliary surface is positioned on at least one of the top surface and side walls.

8. The guidance track system of claim 1, further comprising a peripheral device for simulating a predetermined environment.

9. The guidance track system of claim 8, said peripheral device comprising at least one from the group of a tree, bush, and gate.

10. The guidance track system of claim 1, said system further comprising power supply means for delivering power to said system.

11. The guidance track system of claim 10, means being fabricated on said dielectric substrate.

12. The guidance track system of claim 1, wherein said dielectric substrate comprises at least one of the group of wood, plastic or glass.

13. A guidance track system for an electric powered vehicle having a plurality of wheels on which said vehicle travels, said guidance track system comprising:

a generally planar material having a top surface;

plural substantially parallel grooves formed in said material and open at said top surface, each of said grooves having two generally oppositely facing side walls comprising said material to exert directive forces directly on at least a portion of a respective wheel for guiding said wheel such that said vehicle progresses along said guidance track in the direction of said grooves;

conductive surface means on said top surface of said material in proximate relation to at least one of said grooves and means for providing an electric potential in said conductive surface means;

at least one of said wheels being operative to electrically couple power from said conductive surface means to said vehicles in order to power said vehicle along said guidance track, said material comprising a dielectric substrate, and said conductive surface comprising at least one of a conductive thin film, photo-etching and metal deposition.

14. The guidance track system of claim 13, each of said grooves further comprising a bottom wall.

15. The guidance track system of claim 14, each of said plurality of wheels having a flange portion, said bottom and side walls of each respective groove forming a cavity for receiving said flange portion, and wherein said side walls are operative to exert directive forces on said flange portion as said wheels progress through said grooves.

16. The guidance track system of claim 15, said conductive surface being on said top surfaces, and wherein said at least one wheel operatively to electrically couple power comprises an electrically conductive contact portion which engages in electrically conductive relation with said conductive surface in order to power said vehicle.

17. The guidance track system of claim 13, said guidance track comprising means for facilitating the regrooving of at least one of said wheels on said vehicle in the event at least one of said wheels becomes misaligned.

18. The guidance track system of claim 17, said means for facilitating comprising said top surface in combination with said grooves whereby said misaligned wheel will slide or roll across said top surface in a direction lateral to the direction of said grooves such that said misaligned wheel returns within its respective groove as said vehicle progresses along the track.

19. The guidance track system of claim 13, further comprising circuitry formed in said dielectric substrate said circuitry being operative in connection with said guidance track system.

20. The guidance track system of claim 19, wherein said circuitry comprises said means for providing an electric potential.

21. The guidance track system of claim 13, wherein said at least one of said wheels operative to electrically couple power comprises an electrically conductive material.

22. A guidance track system for an electric powered vehicle having at least one wheel on which said vehicle travels, said guidance track system comprising:

a generally planar material having a top surface;

at least one groove formed in said top surface, said at least one groove having means for receiving at least a portion of said at least one wheel and means for guiding said at least one wheel such that said vehicle progresses along said guidance track system in the direction of said at least one groove;

conductive surface means in proximate relation to said at least one groove for engaging in electrical contact with said at least one wheel; and track controller means for controlling the operation of said vehicle based on electrical information transmitted bi-directionally between said track controller and said vehicle along said conductive surface means.

23. The guidance track system of claim 22, said track controller comprising a digital computer for at least one of sending and receiving digital information along said conductive surface means with respect to a second digital computer in said vehicle.

24. The guidance track system of claim 22, wherein said system comprises two grooves which are substantially parallel.

25. A guidance track system for an electric powered vehicle having at least one wheel on which said vehicle travels, said guidance track system comprising:

a generally planar material having a top surface;

at least one groove formed in said top surface, said at least one groove having means for receiving at least a portion of said at least one wheel and means for guiding said at least one wheel such that said vehicle progresses along said guidance track system in the direction of said at least one groove;

conductive surface means in proximate relation to said at least one groove for engaging in electrical contact with said at least one wheel;

track controller means for controlling the operation of said vehicle based on electrical information transmitted between said track controller means and said vehicle along said conductive surface means, said track controller means comprising a digital computer for at least one of sending and receiving digital information along said conductive surface means with respect to a second digital computer in said vehicle;

said conductive surface means providing a predetermined electric potential to power said vehicle about said track system, and wherein said digital information is communicated by way of modulating said predetermined electric potential.

26. The guidance track system of claim 25, said modulating comprising amplitude modulating.

27. A guidance track system for an electric powered vehicle having a plurality of wheels on which said vehicle travels, said guidance track system comprising:

a generally planar uniform material having a top surface;

plural substantially parallel grooves formed in said top surface, each of said grooves having two generally oppositely facing side walls formed by said uniform material for guiding at least one of said wheels such that said vehicle progresses along said guidance track in the direction of said grooves;

conductive surface means in proximate relation to at least one of said grooves and means for providing an electric potential to said conductive surface means;

wherein at least one of said wheels will be operative to electrically couple power from said conductive surface means to said vehicle in order to power said vehicle along said guidance track;

means for facilitating the regrooving of said wheels on said vehicle in the event one of said wheels becomes misaligned; and said means for facilitating comprising directive traces on said top surface in proximate relation to a portion of at least one of said grooves, and wherein said directive traces form plural channels which tend to direct a flange portion of said misaligned wheel towards its respective groove as said flange portion travels across said directive traces.

28. A method for manufacturing a guidance track system for a vehicle having one or more wheels on said vehicle travels, comprising the steps of:

preselecting a generally planar non-conductive substrate having top and bottom surfaces, each of said top and bottom surfaces comprising a conductive layer;

machining one or more grooves in the top surface of said substrate so as to form one or more grooves in said substrate in which at least a portion of said one or more wheels can rotate therethrough, said machining comprising at least partly separating said conductive layer of said top surface into plural electrically separated portions, whereby said plural portions are defined at least in part by boundaries created by said one or more grooves;

further comprising the step of providing coupling means for coupling a power supply output to plural portions of said conductive layer of said top surface;

said providing step comprising using a plated through hole in said substrate to form an electrical connection between said bottom surface and at least one of said plural portions of said top surface.

29. A guidance track system for a vehicle having at least one wheel on which said vehicle travels, said guidance track system comprising:

a generally planar material having a top surface;

at least one groove formed in said top surface, said at least one groove having means for receiving at least a portion of said at least one wheel and means for guiding said at least one wheel such that said vehicle progresses along said guidance track in the direction of said at least one groove;

a conductive surface on said generally planar material adjacent to said at least one groove for providing a voltage to said vehicle; and wherein said conductive surface comprises a metal layer on the top of said surface above said groove and comprising at least one of a conductive thin film, photo-etched material and deposited metal.

30. The guidance track system of claim 29, wherein said material comprises a dielectric substrate.

* * * * *